US009523371B2

(12) United States Patent
Hollan et al.

(10) Patent No.: US 9,523,371 B2
(45) Date of Patent: Dec. 20, 2016

(54) FAN WITH RESILIENT HUB

(71) Applicant: Delta T Corporation, Lexington, KY (US)

(72) Inventors: C. Jason Hollan, Lexington, KY (US); Richard W. Fizer, Lexington, KY (US)

(73) Assignee: DELTA T CORPORATION, Lexington, KY (US)

( * ) Notice: Subject to any disclaimer, the term of this patent is extended or adjusted under 35 U.S.C. 154(b) by 803 days.

(21) Appl. No.: 13/748,977

(22) Filed: Jan. 24, 2013

(65) Prior Publication Data

US 2013/0189104 A1 Jul. 25, 2013

Related U.S. Application Data

(60) Provisional application No. 61/590,469, filed on Jan. 25, 2012.

(51) Int. Cl.

| | |
|---|---|
| ***F04D 29/32*** | (2006.01) |
| ***F04D 29/34*** | (2006.01) |
| ***F04D 29/02*** | (2006.01) |
| ***F04D 25/08*** | (2006.01) |
| ***F04D 29/60*** | (2006.01) |

(52) U.S. Cl.

CPC ..... *F04D 29/329* (2013.01); *F04D 25/088* (2013.01); *F04D 29/023* (2013.01); *F04D 29/34* (2013.01); *F04D 29/601* (2013.01)

(58) Field of Classification Search

CPC .... F04D 19/002; F04D 29/325; F04D 29/329; F04D 29/34; F04D 29/382

USPC ..... 416/134 A, 134 R, 135

See application file for complete search history.

(56) References Cited

U.S. PATENT DOCUMENTS

| | | | | |
|---|---|---|---|---|
| 3,526,373 | A * | 9/1970 | McLarty | B64C 27/54 244/17.27 |
| 4,156,583 | A | 5/1979 | Mayerjak | |
| 4,321,013 | A | 3/1982 | Schwarz et al. | |
| 4,521,157 | A | 6/1985 | Caramaschi et al. | |
| 6,247,894 | B1 | 6/2001 | Moody et al. | |
| 6,565,320 | B1 * | 5/2003 | Surls | F04D 29/329 416/175 |
| 8,066,480 | B2 | 11/2011 | Madsen | |
| 2003/0002984 | A1 | 1/2003 | Mosiewicz et al. | |

(Continued)

FOREIGN PATENT DOCUMENTS

| | | | |
|---|---|---|---|
| EP | 2397784 | A1 | 12/2011 |
| WO | 9716650 | A1 | 5/1997 |

OTHER PUBLICATIONS

Futura Industries, Benefits of Aluminum, 2008, http://www.futuraind.com/benefits-of-aluminum/.*

*Primary Examiner* — Craig Kim
*Assistant Examiner* — Michael Sehn
(74) *Attorney, Agent, or Firm* — King & Schickli, PLLC

(57) ABSTRACT

A resilient hub assembly comprises a top plate, bottom plate, central hub, and outer spars. The central hub is coupled between the top plate and the bottom plate. The outer spars are coupled between the top plate and the bottom plate, and the outer spars are positioned in a circular arrangement about a common longitudinal axis of the top plate and the bottom plate. The resilient hub assembly is configured to be flexible. The top plate and/or the bottom plate may comprise cutouts, and/or the outer spars may be positioned as to allow a gap between the central hub and the outer spars to promote flexibility.

15 Claims, 10 Drawing Sheets

(56) References Cited

U.S. PATENT DOCUMENTS

| | | | | |
|---|---|---|---|---|
| 2009/0081045 | A1 | 3/2009 | Scherer et al. | |
| 2009/0123284 | A1* | 5/2009 | Madsen | F04D 25/088 416/36 |
| 2009/0208333 | A1* | 8/2009 | Smith | F04D 25/088 416/5 |

* cited by examiner

FAN WITH RESILIENT HUB

PRIORITY

This application claims priority to U.S. Provisional Patent Application Ser. No. 61/590,469, filed Jan. 25, 2012, entitled "Fan With Resilient Hub," the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pat. No. 8,079,823, entitled "Fan Blades," issued Dec. 20, 2011; U.S. Pat. Pub. No. 2009/0208333, entitled "Ceiling Fan System with Brushless Motor," published Aug. 20, 2009; and U.S. Pat. Pub. No. 2010/0278637, entitled "Ceiling Fan with Variable Blade Pitch and Variable Speed Control," published Nov. 4, 2010, the disclosures of which are also incorporated by reference herein. It should be understood that teachings herein may be incorporated into any of the fans described in any of the above-referenced patents, publications, or patent applications.

A fan blade or airfoil may include one or more upper air fences and/or one or more lower air fences at any suitable position(s) along the length of the fan blade or airfoil. Merely exemplary air fences are described in U.S. Pat. Pub. No. 2011/0081246, entitled "Air Fence for Fan Blade," published Apr. 7, 2011, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pat. No. 7,934,907, entitled "Cuffed Fan Blade Modifications," issued May 5, 2011, the disclosure of which is incorporated by reference herein. Still other exemplary winglets are described in U.S. Pat. No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pat. No. 8,162,613, entitled "Angled Airfoil Extension for Fan Blade," issued Apr. 24, 2012, the disclosure of which is incorporated by reference herein. Other suitable structures that may be associated with an outer tip of an airfoil or fan blade will be apparent to those of ordinary skill in the art.

Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, an interface component is described in U.S. Pat. No. 8,147,204, entitled "Aerodynamic Interface Component for Fan Blade," issued Apr. 3, 2012, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pat. No. 8,152,453, entitled "Ceiling Fan with Angled Mounting," issued Apr. 10, 2012, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Examples of such mounting structures are shown in U.S. Design Pat. No. D635,237, entitled "Fan with Ground Support," issued Mar. 29, 2011, the disclosure of which is incorporated by reference herein; U.S. Design Pat. No. D641,075, entitled "Fan with Ground Support and Winglets," issued Jul. 5, 2011, the disclosure of which is incorporated by reference herein; and U.S. Pat. App. No. 61/720,077, entitled "Fan Mounting System," filed Oct. 30, 2012, the disclosure of which is incorporated by reference herein. Alternatively, any other suitable mounting structures and/or mounting techniques may be used in conjunction with embodiments described herein.

It should also be understood that a fan may include sensors or other features that are used to control, at least in part, operation of a fan system. For instance, such fan systems are disclosed in U.S. Pat. No. 8,147,182, entitled "Ceiling Fan with Concentric Stationary Tube and Power-Down Features," issued Apr. 3, 2012, the disclosure of which is incorporated by reference herein; U.S. Pat. No. 8,123,479, entitled "Automatic Control System and Method to Minimize Oscillation in Ceiling Fans," issued Feb. 28, 2012, the disclosure of which is incorporated by reference herein; U.S. Pat. Pub. No. 2010/0291858, entitled "Automatic Control System for Ceiling Fan Based on Temperature Differentials," published Nov. 18, 2010, the disclosure of which is incorporated by reference herein; U.S. Provisional Patent App. No. 61/165,582, entitled "Fan with Impact Avoidance System Using Infrared," filed Apr. 1, 2009, the disclosure of which is incorporated by reference herein; and U.S. Pat. App. No. 61/720,679, entitled "Integrated Thermal Comfort Control System Utilizing Circulating Fans," filed Oct. 31, 2012, the disclosure of which is incorporated by reference herein. Alternatively, any other suitable control systems/features may be used in conjunction with embodiments described herein.

In some settings, it may be desirable to replicate or approximate the function of a winglet in a component that may be located at a position on a fan blade other than at the free end of the fan blade. For instance, such components are disclosed in U.S. Pat. Pub. No. 2011/0081246, entitled "Air Fence For Fan Blade," published Apr. 7, 2011, the disclosure of which is incorporated by reference herein. Such a component may provide an effect on fan efficiency similar to the effect provide by a winglet, albeit at one or more additional regions of the fan blade. In particular, such a component or accessory may serve as an aerodynamic guide or air fence, interrupting slippage of air along the length or longitudinal axis of the fan blade; and redirecting the air flow to a direction perpendicular to the longitudinal axis of the fan blade, above and/or below the fan blade.

While a variety of fans and fan systems have been made and used, it is believed that no one prior to the inventors has made or used a fan system as described herein.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
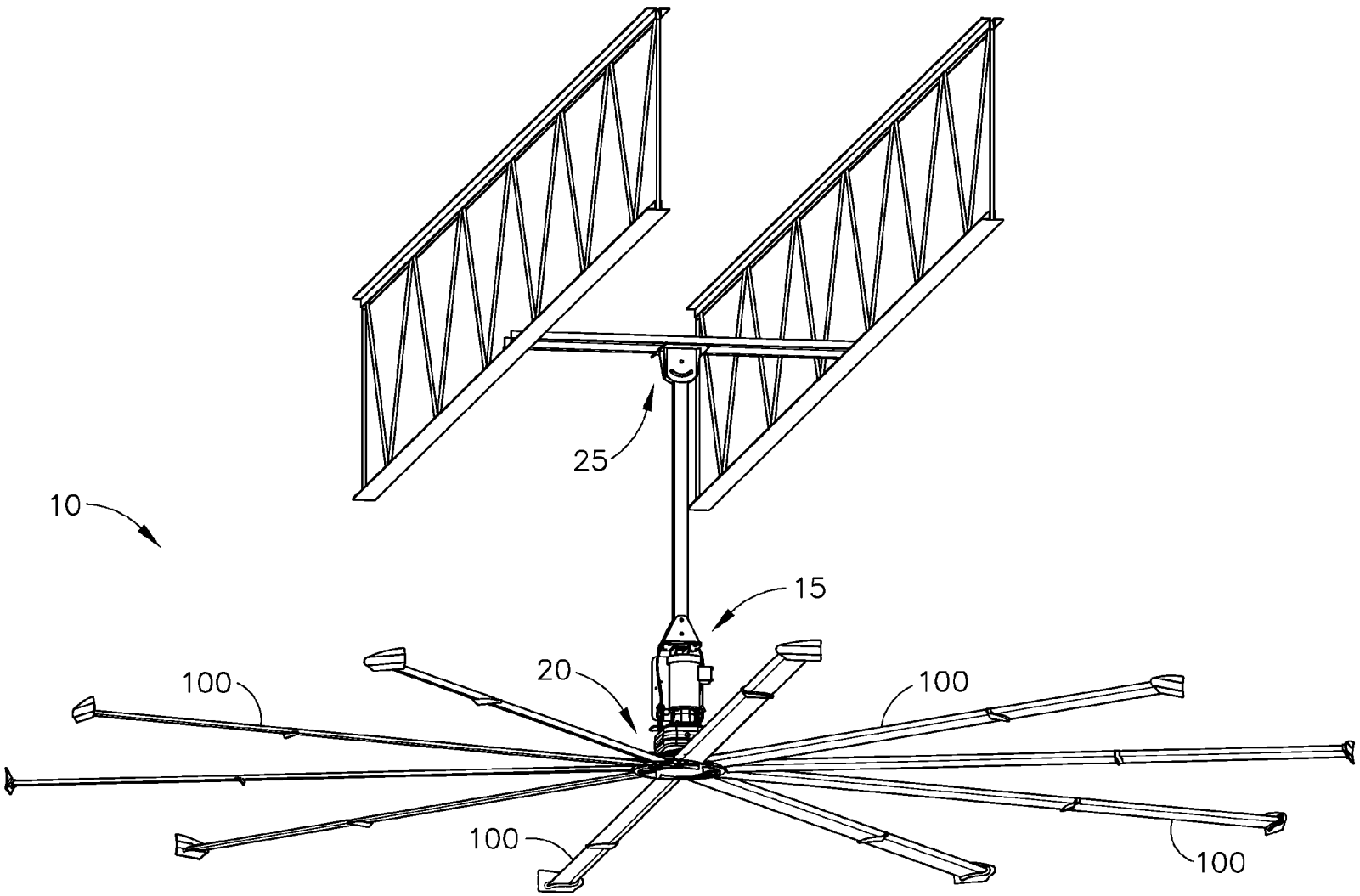
FIG. 1 depicts a perspective view of an exemplary fan having an exemplary hub assembly and a plurality of fan blades coupled thereto.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

I. Exemplary Fan Overview

As shown in FIG. 1, an exemplary fan (10) comprises a motor assembly (15), a hub assembly (20), and a plurality of fan blades (100) coupled to the hub assembly (20). In the present example, fan (10) (including hub assembly (20) and fan blades (100)) has a diameter of approximately 8 feet. In other variations, fan (10) has a diameter between approximately 6 feet, inclusive, and approximately 24 feet, inclusive. Alternatively, fan (10) may have any other suitable dimensions. Except as otherwise described herein, fan (10) may be constructed and operable in accordance with at least some of the teachings of any of the references that are cited herein; and/or in any other suitable fashion.

The motor assembly is operably coupled to hub assembly (20) such that the motor assembly rotates hub assembly (20) relative to the motor assembly. It should be understood that when fan blades (100) are coupled to hub assembly (20), the motor assembly also rotates fan blades (100). The motor assembly may comprise an AC induction motor having a drive shaft that is coupled to hub assembly (20), though it should be understood that the motor assembly may alternatively comprise any other suitable type of motor (e.g., a permanent magnet brushless DC motor, a brushed motor, an inside-out motor, etc.). By way of example only, the motor assembly may be constructed in accordance with at least some of the teachings of U.S. Pat. Pub. No. 2009/0208333, entitled "Ceiling Fan System with Brushless Motor," published Aug. 20, 2009, the disclosure of which is incorporated by reference herein. Furthermore, fan (10) may include control electronics that are configured in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Alternatively, the motor assembly may have any other suitable components, configurations, functionalities, and operability, as will be apparent to those of ordinary skill in the art in view of the teachings herein.

The motor assembly may be coupled to a support (25) adapted to couple fan (10) to a ceiling or other support structure. By way of example only, the support may be configured in accordance with the teachings of U.S. Pat. Pub. No. 2009/0072108, entitled "Ceiling Fan with Angled Mounting," published Mar. 19, 2009, the disclosure of which is incorporated by reference herein, and/or in any other suitable configuration. In other versions, the motor assembly may be directly coupled to the ceiling or other support structure. Further still, the motor assembly may be remote from hub assembly (20) and may be coupled via an axle or other component that is operable to transmit rotational movement to hub assembly (20) from the motor assembly.

II. Exemplary Fan Blades and Modifications

Figure 3:
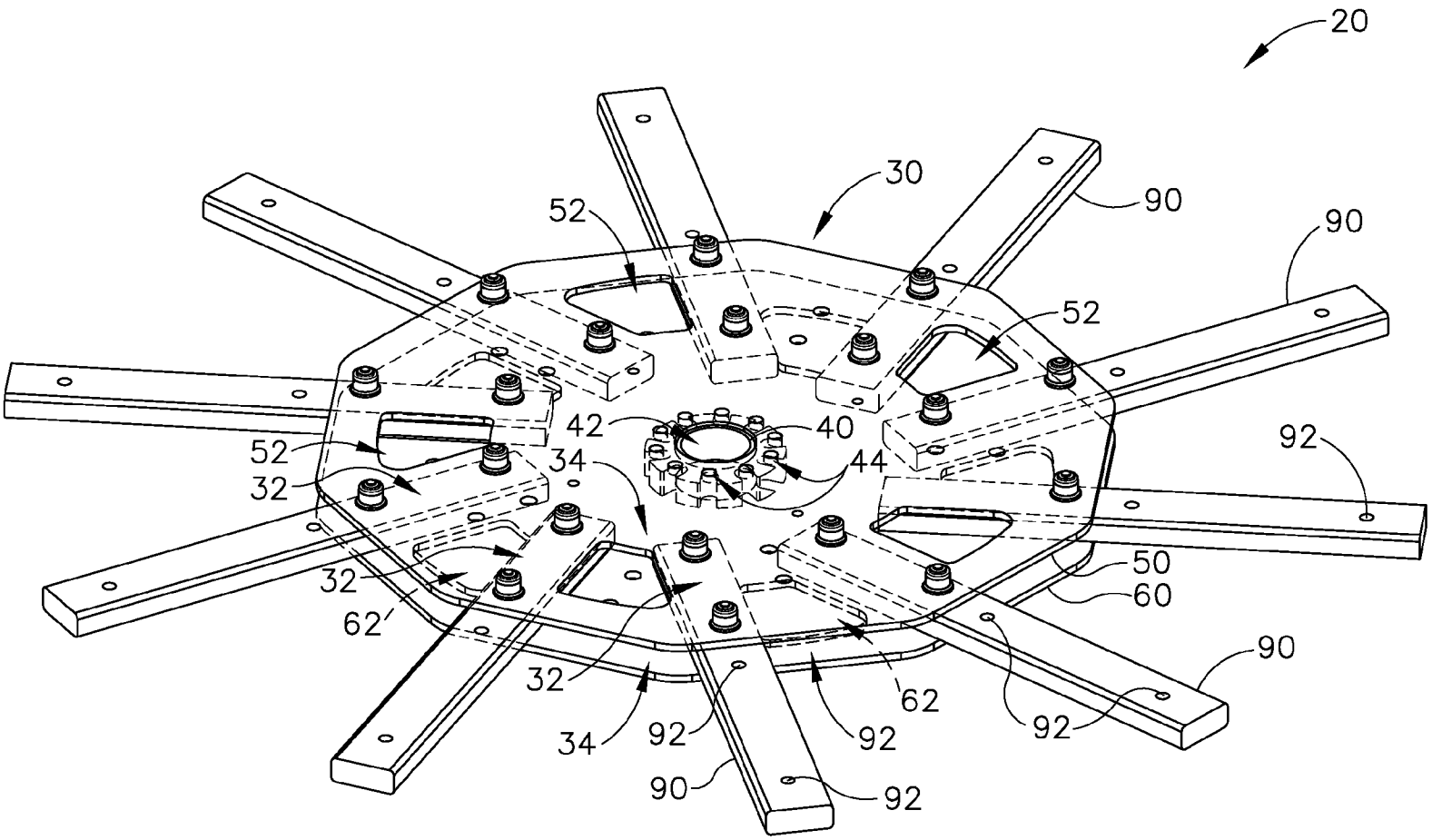
FIG. 3 depicts a perspective view of the exemplary hub assembly of FIG. 1 showing a pair of exemplary resilient plates and a plurality of exemplary outer spars.
Figure 4:
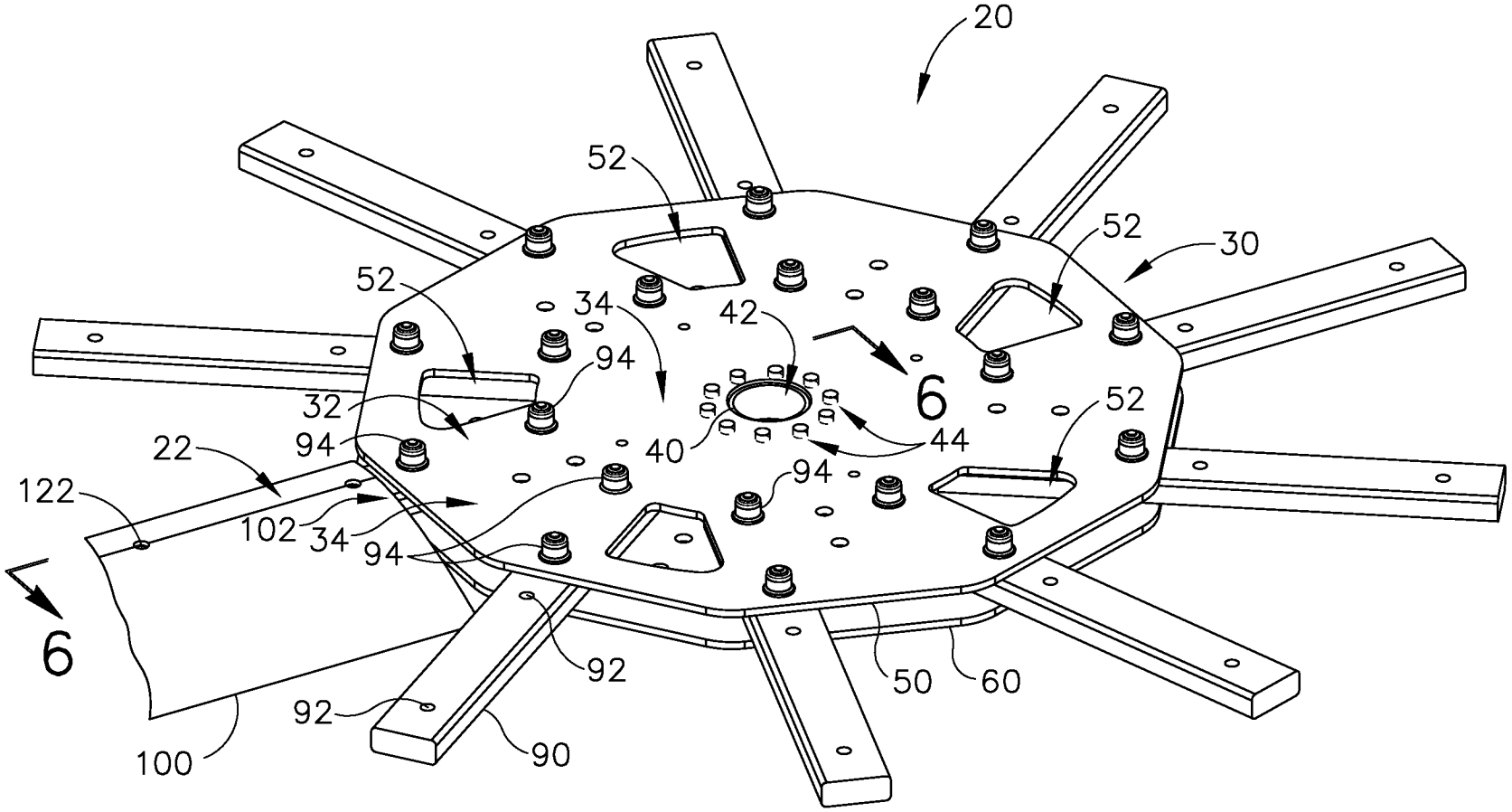
FIG. 4 depicts a partial perspective view of the hub assembly of FIG. 3 showing an exemplary fan blade attached to an outer spar.

As depicted in FIGS. 1 and 3-4, an exemplary fan blade (100) comprises a first end (102) and a second end (not shown). Each fan blade (100) is coupled to hub assembly (20) at first end (102), and each fan blade (100) extends radially outwardly from hub assembly (20), as will be described in more detail below. In the present example, each fan blade (100) comprises an interior channel (110) and a pair of attachment openings (120). Interior channel (110) is configured to receive an outer spar (90) of hub assembly (20), as will be described in greater detail below. A pair of attachment openings (120) are formed vertically through each fan blade (100) such that an attachment component (122) can be inserted through attachment openings (120) of each fan blade (100) and holes (92) of each outer spar (90) to further secure each fan blade (100) to a corresponding out spar (90). Attachment component (122) may include a bolt, screw, rivet, clip, and/or any other attachment component. In some versions, attachment openings (120) are configured to recess attachment component (122) (e.g., in a countersink, etc.), such that an exterior surface of each fan blade (100) is substantially smooth. Of course it should be understood that attachment components (122) and/or attachment openings (120) are merely optional. In addition or in the alternative, interior channel (110) may form a frictional fit with outer spar (90). In some versions, interior channel (110) may further or alternatively include a plurality of bosses (not shown) that form a friction fit with outer spar (90). In still another version or in addition to the versions described above, a longitudinal attachment member (not shown) may extend longitudinally through each fan blade (100) and couple at a first end to outer spar (90) and at a second end to the second end of each fan blade (100). Of course still further configurations and attachment assemblies will be apparent to one of ordinary skill in the art in view of the teachings herein.

Fan blades (100) of the present example comprise extruded aluminium airfoils, though it should be understood that fan blades (100) may further be constructed in accordance with some or all of the teachings of any of the patents, patent publications, or patent applications cited herein. For example, fan blades (100) may be configured in accordance with the teachings of U.S. Pat. No. 7,284,960, entitled "Fan Blades," issued Oct. 23, 2007; U.S. Pat. No. 6,244,821, entitled "Low Speed Cooling Fan," issued Jun. 12, 2001; and/or U.S. Pat. No. 6,939,108, entitled "Cooling Fan with Reinforced Blade," issued Sep. 6, 2005. The disclosures of each of those U.S. patents are incorporated by reference herein. As another merely illustrative example, fan blades (100) may be configured in accordance with the teachings of U.S. Pat. No. 8,079,823, entitled "Fan Blades," issued Dec. 20, 2011, the disclosure of which is also incorporated by reference herein. As yet another merely illustrative example, fan blades (100) may be configured in accordance with the teachings of U.S. Pat. Pub. No. 2010/0104461, entitled "Multi-Part Modular Airfoil Section and Method of Attachment Between Parts," published Apr. 29, 2010, the disclosure of which is incorporated by reference herein. Alternatively, any other suitable configurations for fan blades (100) may be used in conjunction with the examples described herein. In the present example, fan blades (100) are formed of aluminum through an extrusion process such that each fan blade (100) has a substantially uniform cross section along its length. It should be understood that fan blades (100) may alternatively be formed using any suitable material, or combination of materials, by using any suitable technique, or combination of techniques, and may have any suitable cross-sectional properties or other properties as will be apparent to one of ordinary skill in the art in view of the teachings herein.

Fan blades (100) of the present example may further include a variety of modifications. By way of example only, each fan blade (100) may further comprise a winglet (not shown) coupled to the second end of each fan blade (100). The winglets may be constructed in accordance with some or all of the teachings of any of the patents, patent publications, or patent applications cited herein. For instance, the winglets may be configured in accordance with at least some of the teachings of U.S. Pat. No. 7,252,478, entitled "Fan Blade Modifications," issued Aug. 7, 2007, the disclosure of which is incorporated by reference herein. As another merely illustrative example, the winglets may be configured in accordance with the teachings of U.S. Pat. No. 7,934,907, entitled "Cuffed Fan Blade Modifications," issued May 3, 2011, the disclosure of which is incorporated by reference herein. As yet another merely illustrative example, the winglets may be configured in accordance with the teachings of U.S. Pat. No. D587,799, entitled "Winglet for a Fan Blade," issued Mar. 3, 2009, the disclosure of which is incorporated by reference herein. Of course, any other suitable configuration for the winglets may be used as will be apparent to those of ordinary skill in the art in light of the teachings herein.

It should also be understood that the winglets are merely optional. For instance, other alternative modifications for fan blades (100) may include end caps, angled airfoil extensions, fan blade retention features, integrally formed closed ends, or substantially open ends. By way of example only, an angled extension may be added to the free end of each fan blade (100) in accordance with the teachings of U.S. Pat. Pub. No. 2008/0213097, entitled "Angled Airfoil Extension for Fan Blade," published Sep. 4, 2008, the disclosure of which is incorporated by reference herein. In addition or in the alternative, fan blades (100) may include a retention system in accordance with the teachings of U.S. Pat. Pub. No. 2011/0262278, entitled "Fan Blade Retention System," published Oct. 27, 2011, the disclosure of which is incorporated by reference herein. Other suitable structures that may be associated with second end of each fan blade (100) will be apparent to those of ordinary skill in the art in view of the teachings herein.

III. Exemplary Hub Assembly

In some instances, it may be preferable to have a resilient or flexible hub assembly (20) such that force loads experienced by the hub assembly (20) may be distributed over a larger area instead of being focused at a specific point. For instance, if a fan blade (100) experiences an object strike, a strong draft, or other force, the force may be transmitted to hub assembly (20) and, in some instances, may be concentrated at the main attachment point for fan blade (100). Over time, the concentration of force on the main attachment points for fan blades (100) may result in fatigue of the material of hub assembly (20), thereby potentially reducing the operational life of fan (10). Accordingly, it may be preferable to distribute such loads across a larger area of hub assembly (20) to increase the fatigue life of hub assembly (20) and/or fan (10).

Figure 5:
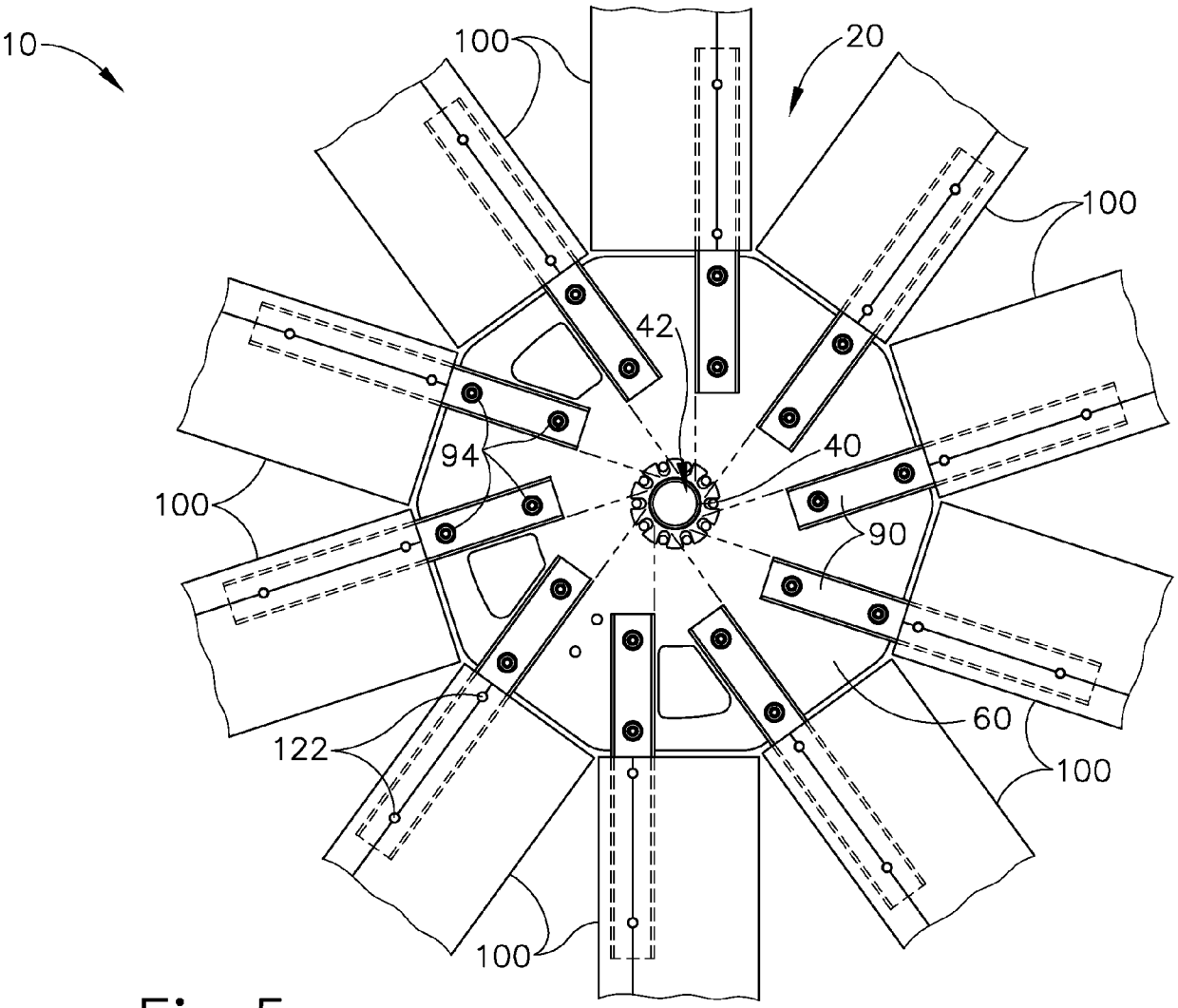
FIG. 5 depicts a top view of the hub assembly of FIG. 3 showing a common central circle from which the outer spars tangentially extend.
Figure 6:
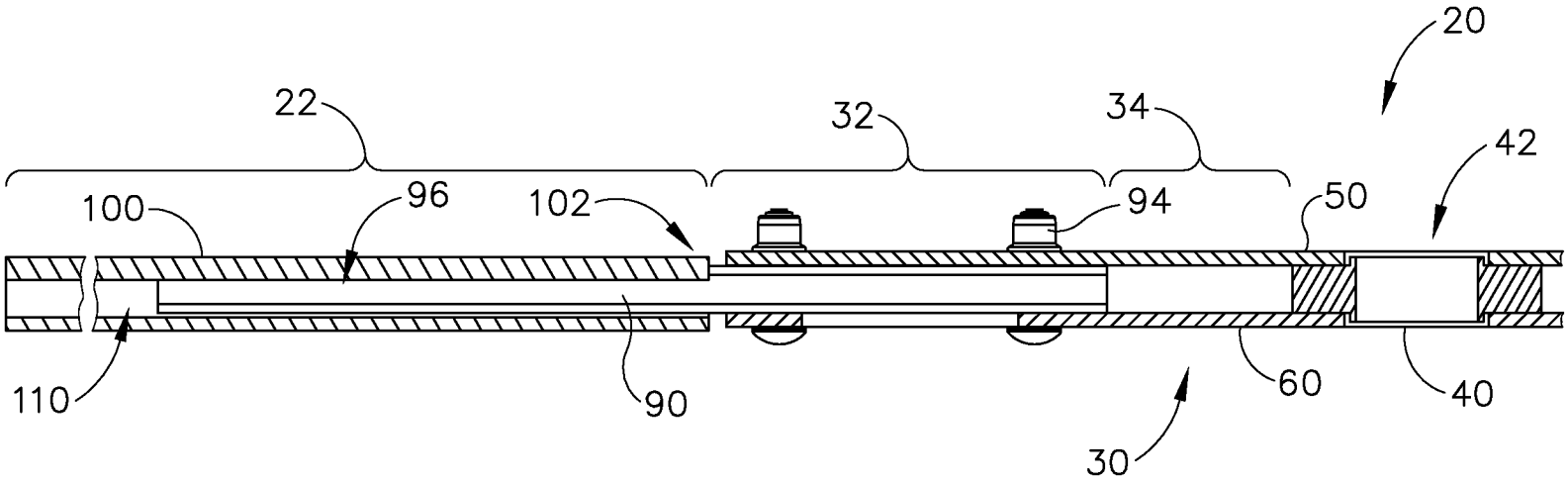
FIG. 6 depicts a partial cross-sectional view of the hub assembly of FIG. 4 taken along section line 6-6 of FIG. 4, depicting the exemplary outer spar coupled to the fan blade.
Figure 7:
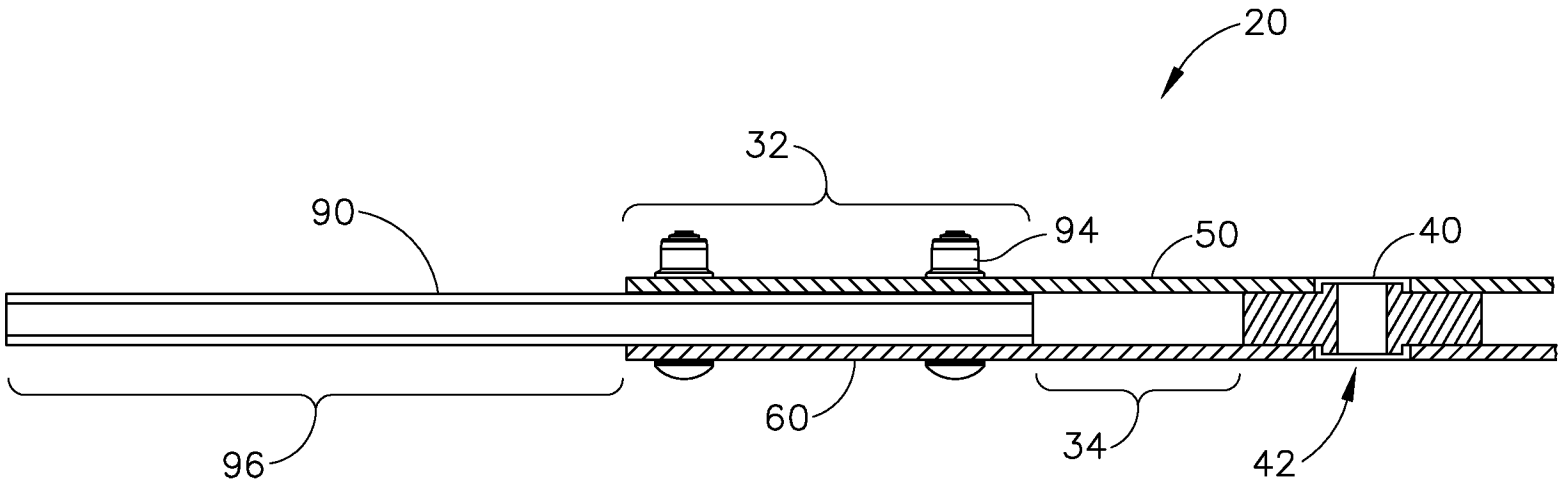
FIG. 7 depicts a partial cross-sectional view of an exemplary alternative hub assembly without cutouts.

FIGS. 1-4 depict one merely exemplary hub assembly (20) comprising a main hub (30) and a plurality of outer spars (90) coupled to and extending generally outwardly from main hub (30). In some versions, spars (90) extend outwardly along radii terminating at a common central point. However, in the present example, spars (90) extend tangentially from a common central circle as shown in FIG. 5. For instance, spars (90) may extend tangentially from a circle defined by central hub (40), which is described in greater detail below. Other suitable orientations and arrangements will be apparent to those of ordinary skill in the art in view of the teachings herein. Referring briefly to FIGS. 3-4, each outer spar (90) is coupled to a corresponding first end (102) of a fan blade (100) such that rotation of hub assembly (20) rotates fan blades (100). As noted above, holes (92) through outer spars (90) permit attachment component (122) to couple fan blades (100) to outer spars (90). Outer spars (90) are fixedly coupled to main hub (30) via bolts (94), though it should be understood that other attachment members, features, or techniques may be used. Thus, hub assembly (20) is a substantially open hub with a plurality of outer spars (90) sandwiched between a pair of flexible, resilient disc-shaped plates (50, 60). Main hub (30) of the present example comprises a central hub (40), a top plate (50), and a bottom plate (60). Main hub (30) is also coupled to the motor assembly such that the motor assembly rotates main hub (30) when fan (10) is in use.

Figure 2:
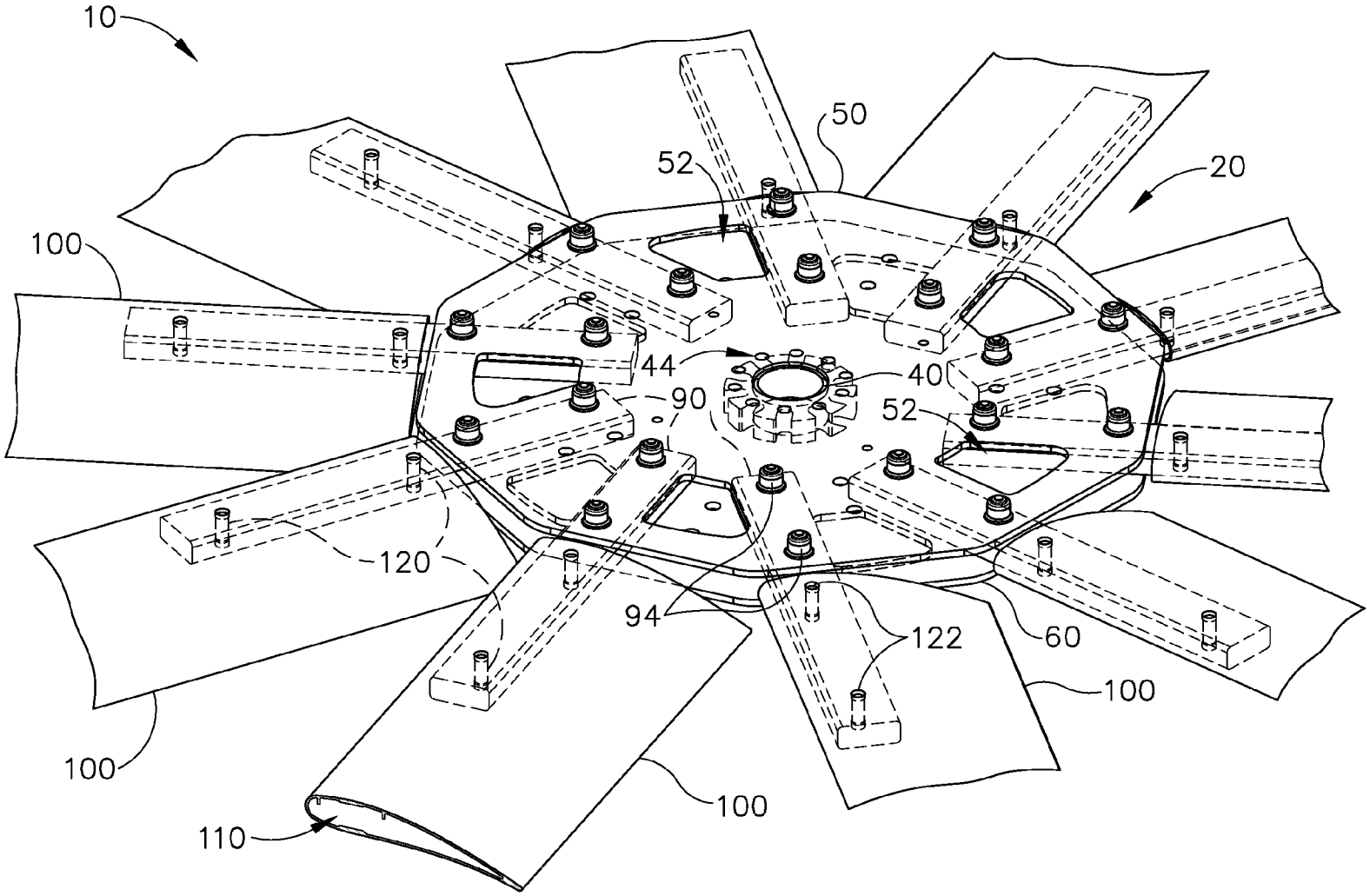
FIG. 2 depicts a partial perspective view of the exemplary fan of FIG. 1 showing the exemplary hub assembly and plurality of fan blades coupled thereto.

In the present example, central hub (40) is interposed between top plate (50) and bottom plate (60) to serve as a spacer between the two plates (50, 60) and also to provide a rigid support for coupling main hub (30) to the motor assembly. As shown in FIG. 2, central hub (40) comprises a cylindrical member having a central opening (42) and a plurality of attachment points (44) angularly disposed about central hub (40). In the present example, central hub (40) comprises a machined aluminium component, though it should be understood that this is merely optional. By way of example only, central hub (40) may comprise a thermoplastic member, a carbon-fiber component, a steel component, a titanium member, and/or any other component as will be apparent to one of ordinary skill in the art in view of the teachings herein. Central opening (42) provides a location through which a portion of the motor assembly and/or other components may pass through hub assembly (20). By way of example only, a shaft of the motor assembly may be inserted through central opening (42) and secured to hub assembly (20) via a pair of attachment plates (not shown) coupled to attachment points (44) on either side of hub assembly (20). In some versions, the motor assembly may be coupled to attachment points (44) via a single attachment plate or member located on top plate (50) with attachment members, such as bolts, screws, clips, etc., extending through attachment points (44). Alternatively, the motor assembly may be coupled to attachment points (44) via a single attachment plate or member located on bottom plate (60) with attachment members, such as bolts, screws, clips, etc., extending through attachment points (44). In addition or in the alternative, central opening (42) may provide a through hole to permit accessories or other items to pass through hub assembly (20). Merely exemplary items that may pass through central opening (42) include electrical wires and/or fire suppression system plumbing in accordance with the teachings of U.S. Pat. Pub. No. 2009/0097975, entitled "Ceiling Fan with Concentric Stationary Tube and Power-Down Features," published Apr. 16, 2009, the disclosure of which is incorporated by reference herein. Of course still further configurations and/or uses for central opening (42) and/or central hub (40) will be apparent to one of ordinary skill in the art in view of the teachings herein.

Figure 8:
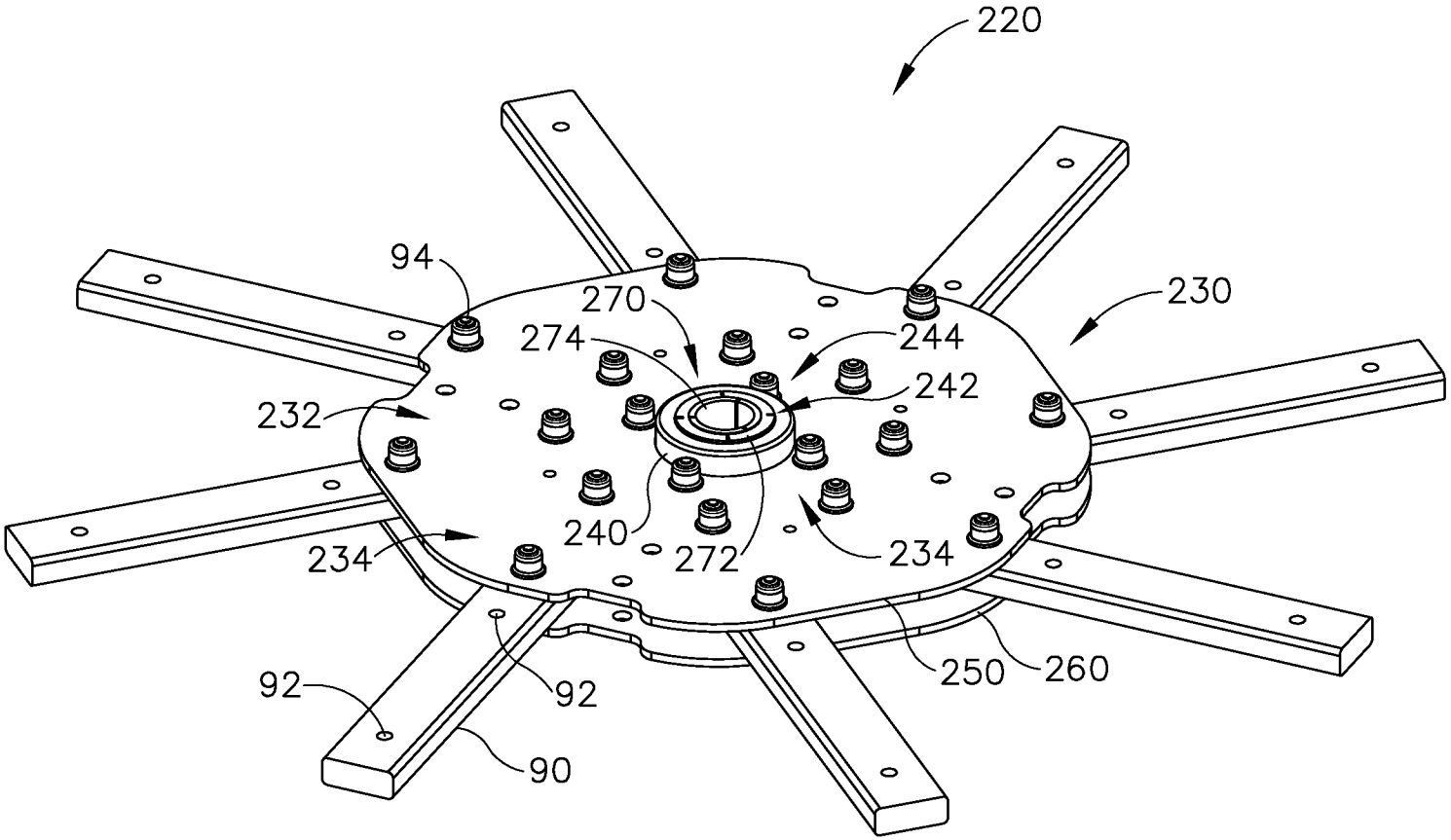
FIG. 8 depicts a partial perspective view of alternative exemplary hub assembly.
Figure 9:
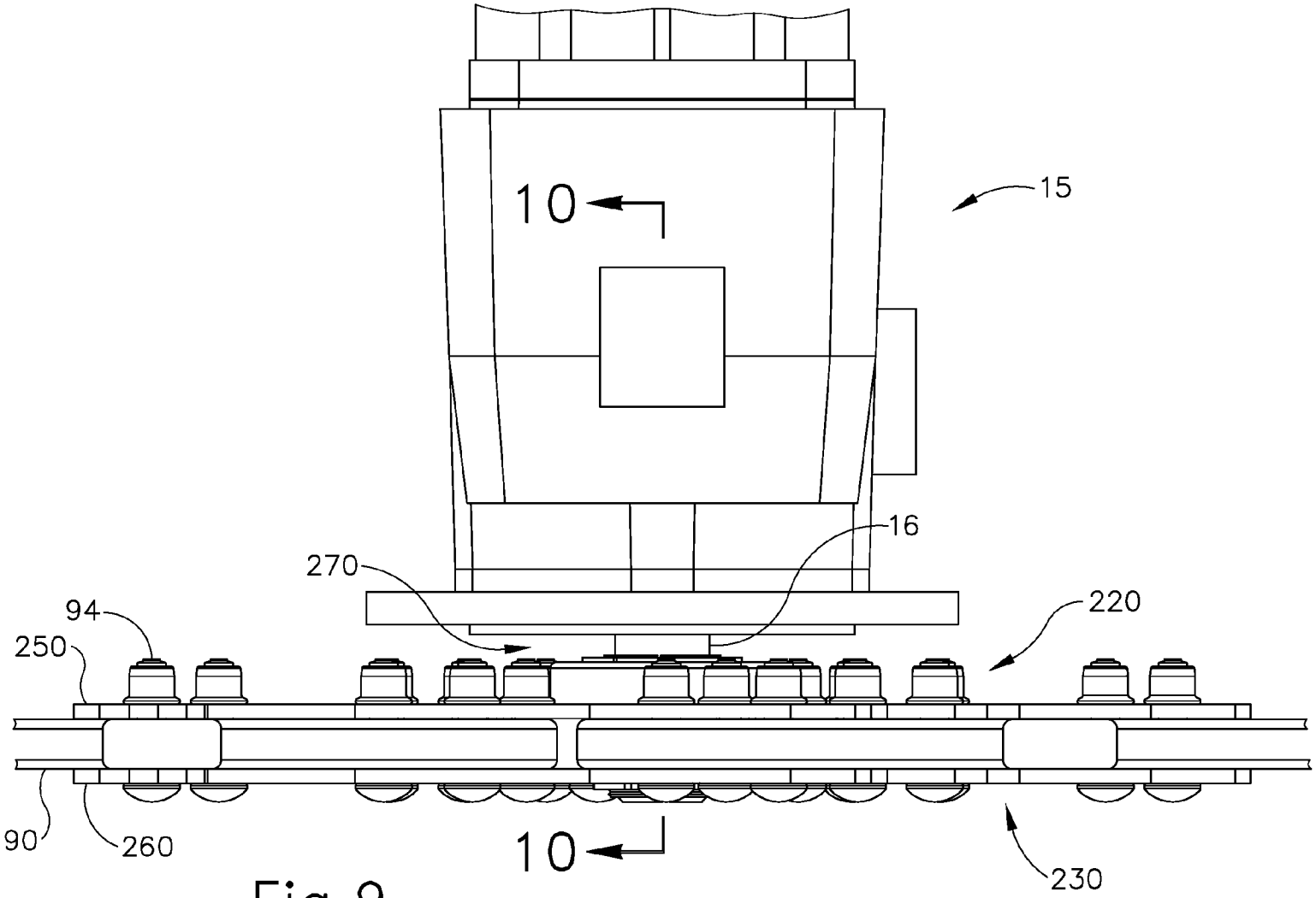
FIG. 9 depicts a partial side view of the hub assembly of FIG. 8 coupled with a motor assembly.
Figure 10:
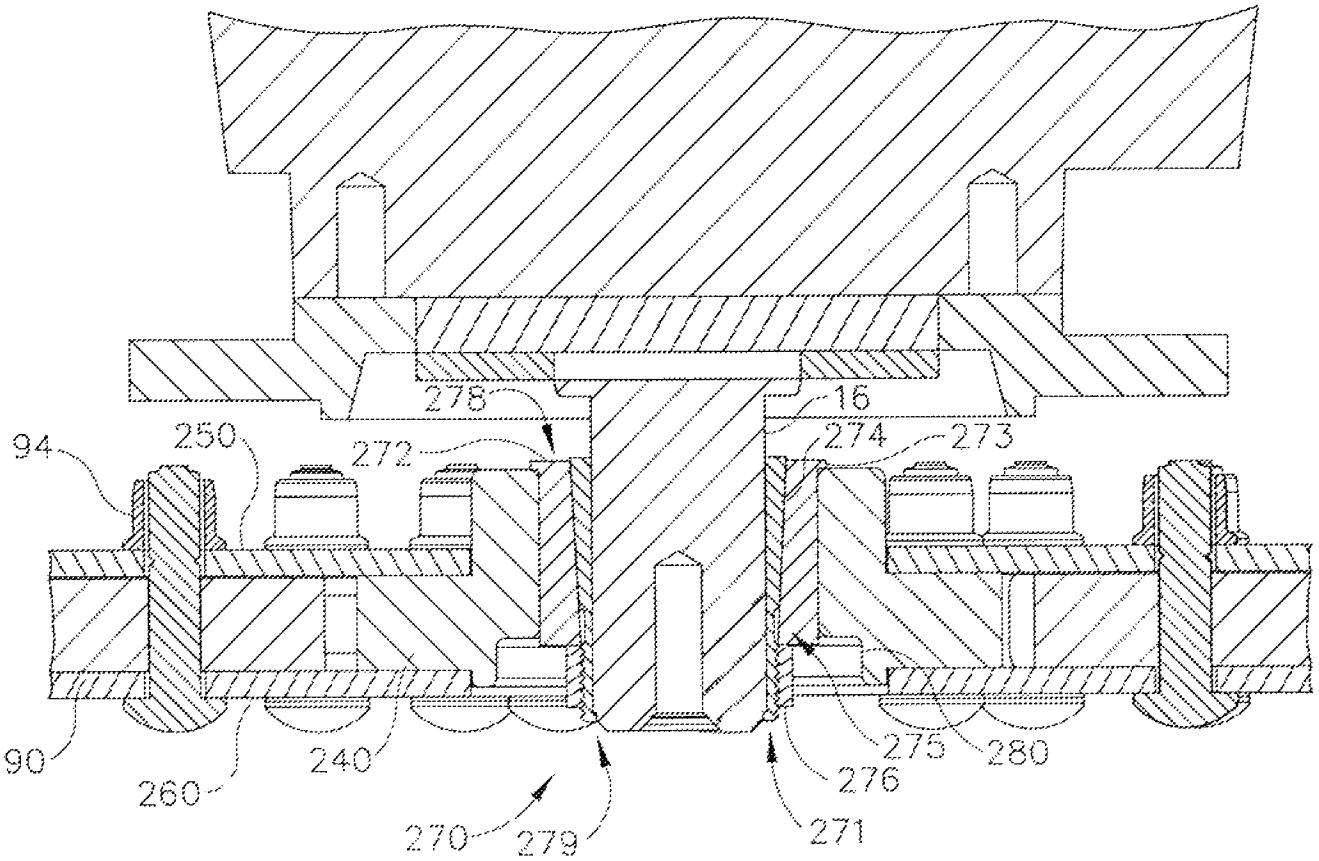
FIG. 10 depicts a partial cross-sectional view of the hub assembly of FIG. 8, taken along line 10-10 of FIG. 9.

As another exemplary method of attachment, a hub assembly (220) may be attached directly to a shaft (16) of motor assembly (15) using a tapered coupling device (270) as shown in FIGS. 8-10. A central hub (240) is interposed between a top plate (250) and a bottom plate (260) to serve as a spacer between the two plates (250, 260) and also to provide a rigid support for coupling main hub (230) to the motor assembly (15). Central hub (240) comprises a cylindrical member having a central opening (242) and a plurality of attachment points (244) angularly disposed about central hub (240). As shown in FIG. 10, central hub (240) further comprises a recess (280) having a larger internal diameter than that of central opening (242). As best seen in FIG. 10, tapered coupling device (270) comprises a sleeve (272), a collar (274) and a lock nut (276). Sleeve (272) is slidably inserted into central opening (242) of central hub (240) and a lip (273) of sleeve (272) rests upon the top surface of central hub (240) and prevents sleeve (272) from moving further into central opening (242) of central hub (240). Sleeve (272) comprises a central opening (275). The internal diameter of central opening (275) of sleeve (272) is tapered such that the internal diameter is greater at a top surface (278) of tapered coupling device (270) and lesser at a bottom surface (279) of tapered coupling device (270). Collar (274) is slidably inserted into central opening (275) of sleeve (272). The external diameter of collar (274) is tapered such that the external diameter is greater at the top surface (278) of tapered coupling device (270) and lesser at the bottom surface (279) of tapered coupling device (270). The external diameter of collar (274) thus complements the internal diameter of sleeve (272). Collar (274) also comprises a threaded portion (271) located proximal to the bottom surface (279) of tapered coupling device (270). The taper of collar (274) and the external diameter of threaded portion (271) of collar (274) are such that at least a portion of threaded portion (271) is accessible within recess (280) when collar (274) is inserted into central opening (275) of sleeve (272). Locknut (276) threads onto the threaded portion (271) of collar (274) and as locknut (276) is tightened, collar (274) is pulled downward in a vertical direction along central opening (275) of sleeve (272). This pulling downward creates both an internal pressure upon shaft (16) and an external pressure upon central hub (240). This is because as collar (274) is pulled downward, sleeve (272) remains in place due to lip (273) and therefore the combined diameter of collar (274) and sleeve (272) at any point along central opening (242) of central hub (240) becomes greater due to the tapers of both collar (274) and sleeve (272). The pressures created by tapered coupling device (270) act to keep shaft (16) coupled directly to hub assembly (220). Of course still further configurations and/or methods of attachment will be apparent to one of ordinary skill in the art in view of the teachings herein.

As discussed above, central hub (40) is interposed between a top plate (50) and a bottom plate (60). Top plate (50) and bottom plate (60) comprise generally disc-shaped flexible members. In the present example, top plate (50) and bottom plate (60) comprise thin metal discs, such as aluminium, steel, titanium, etc., though this is merely optional. In some versions, top plate (50) and bottom plate (60) may comprise thermoplastic discs, fiberglass discs, carbon fiber discs, and/or any other material as will be apparent to one of ordinary skill in the art in view of the teachings herein. Top plate (50) and bottom plate (60) further include a plurality of cutouts (52, 62). As best seen in FIG. 2, cutouts (52, 62) are positioned about top plate (50) and bottom plate (60) such that a cutout (52, 62) is positioned between each successive outer spar (90) and cutouts (52,62) alternate between a cutout (52) of top plate (50) and a cutout (62) of bottom plate (60). In other words, there is no cutout (62) below each cutout (52); and there is no cutout (52) above each cutout (62) in the present example. Cutouts (52, 62) of the present example reduce the rigidity of top plate (50) and bottom plate (60) to provide additional flexibility to top plate (50) and bottom plate (60) such that main hub (30) may resiliently deform and flex in response to forces on fan blades (100). In some versions, cutouts (52, 62) may be positioned between each successive outer spar (90) and not alternate between a cutout (52) of top plate (50) and a cutout (62) of bottom plate (60) such that a pair of cutouts (52, 62) are positioned between each successive outer spar (90). In yet a further version, shown in FIG. 5, cutouts (52, 62) may be omitted and top plate (50) and bottom plate (60) are substantially continuous plates (50, 60) that resiliently deform and flex between each successive outer spar (90).

It should be understood from the foregoing that main hub (30) is divided into overlap regions (32), where outer spars (90) are coupled to both top plate (50) and bottom plate (60); and flexible regions (34) between each successive outer spar (90) and between the end of each outer spar (90) and central hub (40). Flexible regions (34) permit resilient deformation and/or flexing of main hub (30) when a load is applied to one or more outer spars (90) such that the load applied to the one or more outer spars (90) is distributed through some or all of main hub (30). FIG. 4 depicts a radial portion of hub assembly (20) of FIGS. 1-3 showing an exemplary flexible region (34), an overlap region (32), and an outer flexible region (22) for an outer spar (90) and fan blade (100). Outer flexible region (22) comprises an outer portion (96) of outer spar (90) and a corresponding fan blade (100) coupled to outer portion (96). Overlap region (32) comprises the portion main hub (30) where outer spar (90) is coupled to top plate (50) and bottom plate (60). Flexible region (34) comprises the portions of top plate (50) and bottom plate (60) that extend from overlap region (32) to central hub (40). In the present example, flexible regions (22, 34) permit deflection and/or resilient deformation of the fan blade (100) and/or main hub (30) while overlap region (32) provides sufficient rigidity to support fan blade (100) during operation of fan (10). Of course it should be understood that top plate (50) and bottom plate (60) may also resiliently deform and/or flex in overlap region (32) as well. In some versions, outer spars (90) may also be configured to resiliently deform or flex. In the present example, when a fan blade (100) experiences a load, fan blade (100) deflects at outer flexible region (22) to distribute the load across fan blade (100) and a portion of outer spar (90). In addition to this deflection, flexible region (34) also permits resilient deformation and flexing of main hub (30) such that the load on fan blade (100) is also distributed across some or all of main hub (30). The material, shapes, and thicknesses of central hub (40), top plate (50), bottom plate (60), outer spar (90), and/or fan blade (100) are determined such that hub assembly (20) provides sufficient rigidity for fan (10) to operate while distributing the loads on fan blades (100) across a sufficiently large portion of hub assembly (20) to minimize the stresses within hub assembly (20). Of course further materials and configurations for top plate (50), bottom plate (60), and/or hub assembly (20) will be apparent to one of ordinary skill in the art in view of the teachings herein.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A hub assembly comprising:

a. a top plate, wherein the top plate is flexible;

b. a bottom plate, wherein the bottom plate is flexible, wherein the top plate and bottom plate are coupled together and are configured to form a central hub defining a longitudinal axis of the top plate and the bottom plate, wherein the top plate and the bottom plate each comprise a plurality of cutouts arranged in an angular array about the common longitudinal axis of the top plate and the bottom plate;

c. a plurality of outer spars, wherein the outer spars are coupled to and extend generally outwardly from the top plate and the bottom plate, and wherein the cutouts of the top plate and of the bottom plate are positioned within alternating gaps of successive outer spars; and d. a plurality of fan blades, wherein each of the outer spars of the plurality of outer spars is disposed within a fan blade.

2. The hub assembly of claim 1, wherein the central hub is configured to provide a rigid support for coupling of the hub assembly to a motor assembly.

3. The hub assembly of claim 1, wherein the top plate and bottom plate are generally disc-shaped.

4. The hub assembly of claim 1, wherein the plurality of cutouts arranged in an angular array radially spaced from the common longitudinal axis of the top plate and the bottom plate.

5. The hub assembly of claim 1, wherein the outer spars are positioned between the top plate and the bottom plate, and wherein the outer spars are positioned to provide a flexible gap between the outer spar and an exterior of the central hub.

6. The hub assembly of claim 1, wherein the plurality of spars extends tangentially from a common central point.

7. The hub assembly of claim 1, wherein the plurality of spars extends tangentially from a common central circle.

8. The hub assembly of claim 1, wherein the plurality of spars extends angularly from a common central circle.

9. The hub assembly of claim 1, wherein each of the fan blades of the plurality of fan blades comprises slot configured to receive one of the outer spars of the plurality of outer spars.

10. The hub assembly of claim 9, wherein each of the fan blades of the plurality of fan blades and each of the outer spars of the plurality of outer spars comprises a plurality of mounting holes.

11. A fan hub assembly comprising:

a. a flexible top plate;

b. a flexible bottom plate, wherein the top plate and bottom plate are coupled together and are thereby configured to form a hub defining a longitudinal axis of the top plate and the bottom plate;

c. a plurality of arms, wherein the arms are coupled with and extend generally outwardly from the top plate and the bottom plate, and wherein the top plate and the bottom plate each comprise a plurality of cutouts arranged in an angular array about the common longitudinal axis of the top plate and the bottom plate, and wherein the plurality of cutouts of the top plate and of the bottom plate are positioned within alternating gaps of successive arms; and d. a plurality of fan blades, wherein each of the arms of the plurality of arms is disposed within a fan blade.

12. The fan hub assembly of claim 11, wherein the arms are positioned between the top plate and the bottom plate, and wherein the arms are positioned to allow for a flexible gap between the rigid hub and the arm.

13. A fan assembly comprising:

a. a flexible top plate;

b. a flexible bottom plate, wherein the top plate and bottom plate are coupled together and are configured to form a central hub defining a longitudinal axis of the top plate and the bottom plate;

c. a plurality of outer spars, wherein the outer spars are coupled between and extending generally outwardly from the top plate and the bottom plate, and wherein the top plate and the bottom plate each comprise a plurality of cutouts arranged in an angular array about the common longitudinal axis of the top plate and the bottom plate and the plurality of cutouts are positioned within alternating gaps of successive outer spars; and d. a plurality of fan blades, wherein each fan blade of the plurality of fan blades, corresponds to and is coupled with an outer spar of the plurality of outer spars.

14. The fan assembly of claim 13, wherein the central hub is coupled to a motor assembly.

15. The fan assembly of claim 14, wherein the motor assembly is integrated with a climate control system.

* * * * *